US010880954B2

(12) United States Patent
Lollar

(10) Patent No.: US 10,880,954 B2
(45) Date of Patent: Dec. 29, 2020

(54) FOLDABLE ELECTRIC RESISTANCE HEATER AND METHOD OF USE

(75) Inventor: James Patrick Lollar, Baxter, TN (US)

(73) Assignee: TUTCO, LLC, Cookeville, TN (US)

( * ) Notice: Subject to any disclaimer, the term of this patent is extended or adjusted under 35 U.S.C. 154(b) by 302 days.

(21) Appl. No.: 12/940,543

(22) Filed: Nov. 5, 2010

(65) Prior Publication Data

US 2012/0111853 A1 May 10, 2012

(51) Int. Cl.
*H05B 3/26* (2006.01)

(52) U.S. Cl.
CPC ..... *H05B 3/26* (2013.01); *H05B 2203/014* (2013.01)

(58) Field of Classification Search
CPC ..... H05B 2203/003; H05B 2203/014; H05B 2203/022; H05B 3/06; H05B 3/16; H05B 3/26; H05B 3/76; H05B 3/68; H05B 3/30; H05B 3/28; H05B 3/20; H05B 3/18; H05B 3/10; H05B 3/14; G06Q 30/0267
USPC ..... 219/524, 525, 547, 532, 538, 536, 219/548–553; 392/350, 472; 99/385
See application file for complete search history.

(56) References Cited

U.S. PATENT DOCUMENTS 3,265,864 A * 8/1966 Levinson ..... 219/545
3,286,078 A * 11/1966 Hynes ..... 392/472
3,406,275 A * 10/1968 Pedrotti ..... 219/406
3,963,859 A * 6/1976 Petersen et al. ..... 174/148
5,111,678 A * 5/1992 Evans et al. ..... 72/134
5,334,818 A * 8/1994 Edwards et al. ..... 219/539
5,641,421 A * 6/1997 Manov et al. ..... 219/553
6,311,609 B1 * 11/2001 Dotan ..... A47J 37/0807 219/521
2007/0278211 A1 * 12/2007 Arens et al. ..... 219/536
2008/0238600 A1 * 10/2008 Olson ..... 336/180
2010/0193505 A1 * 8/2010 Peck ..... 219/548
2010/0282735 A1 * 11/2010 Fattorel et al. ..... 219/520

FOREIGN PATENT DOCUMENTS

CN 1287465 3/2001
CN 1493170 4/2004
CN 101647156 2/2010
CN 101801124 8/2010

* cited by examiner

*Primary Examiner* — Tu B Hoang
*Assistant Examiner* — Diallo I Duniver
(74) *Attorney, Agent, or Firm* — Clark & Brody LP

(57) ABSTRACT

A foldable electric resistance heater comprises at least a pair of insulator plates with a resistance wire threaded through openings in the insulator plates. In one mode, the insulator plates are folded with respect to each other and fastened together using one or more fasteners. In another mode, the plates can have other angled configurations with respect to each other. One or more insulators is positioned between the folded plates or adjacent the plates to isolate the resistance wire. The folded plate configuration and resistance wire provide significant advantages in manufacturing costs while forming a more robust heater configuration.

28 Claims, 5 Drawing Sheets

FOLDABLE ELECTRIC RESISTANCE HEATER AND METHOD OF USE

FIELD OF THE INVENTION

The present invention is directed to an electric resistance heater with an improved insulator configuration and, particularly to a heater that allows the insulator plates supporting the resistance wires to fold to form a more robust or flexible heater configuration.

BACKGROUND ART

In the prior art, electrical resistance wire heaters are well known. These heaters are used in a variety of applications to heat a fluid, which is generally a moving stream of air. One typical application is for clothes dryers, wherein a stream of air is heated for drying clothes.

One type of these heaters is illustrated in FIGS. 1-3. The heater is designated by the reference numeral 10 and employs a ribbon resistance wire 1, which has a square or rectangular cross section, as opposed to other heaters that employ resistance wires that would have a circular cross section. The heater 10 comprises a pair of insulator plates 3 and 5, each of which having a number of openings therethrough. The openings located in the insulators plates 3 and 5 are positioned so that the ribbon follows a path along the insulators from a first terminal end 9 of the wire to a second terminal end 11. The terminal ends 9 and 11 then link to a power source via terminals and lead wires or some other connection to bring power to the heater. The plates 3 and 5 are typically supported by the ends of the plates engaging slots in a heater frame; the plates are not fastened to the frame so that they can move. However, since the frame receiving the ends of the plates are spaced apart, the resistance wire extending between the plates still maintains the spacing between the plates as they extend between the frame.

FIG. 1 shows one configuration wherein the ribbon 1 follows a convoluted path 4 between the two plates 3 and 5. The ribbon 1 passes through a first opening 13 in plate 3, travels a certain distance, then passes through opening 15, forms a loop, and passes back through opening 15 in the second plate 5. The ribbon 1 then travels to plate 3, entering opening 17, forming another loop, and passing back through the same opening 17 and towards the plate 5. This looping continues until the terminal end 11 of the ribbon ends at the opposite end of plate 3.

In a preferred configuration, the ribbon is shaped with expanded and spaced apart portions 21 and 22. The portions are formed along the length of the ribbon at locations such that a part of the insulator plate is positioned between the spaced apart portions 21 and 22. This arrangement holds the two insulator plates 3 and 5 in place so as to assist in maintaining the spacing of the plates when the ribbon passes through the openings in the plates 3 and 5.

The spacing of the two insulator plates can vary as the heater requirements would dictate. Typically, the spacing distance "A", see FIG. 1, is on the order of about 1 inch. This spacing is often dictated by the particular heater application.

The path of travel of the wire is dictated by the number and spacing of the openings in the plates 3 and 5. FIG. 2 shows a typical arrangement of openings, wherein the ribbon would travel down a first row 24, crossover at opening 23, and travel down second row 25, so that the first end 27 of the wire and second end 29 of the wire terminate at the same side of the heater so that connection to a power source is facilitated.

FIG. 3 shows another prior art heater configuration wherein only one row 30 and 31 exists for each of the plates 33 and 35, respectively. Starting at one end 32 of plate 33 and at end 36 of wire 1, the wire loops through plates 33 and 35, terminating at a second end 38 on the opposite end of the plates 33 and 35. It can be seen here that to move the wire along the plates, plate 33 has five opening whereas plate 35 has only four openings, and that the openings in the plates are offset with respect to each other so that the looping of the ribbon can occur. This means that two different plate configurations are needed to make this heater, which increases manufacturing costs.

The heater application usually controls the length of resistance wire needed to get the correct number of ohms to produce the wattage required based on the voltage source used. This results in defining the size of the insulator plate and number of openings therein for the wire travel. Generally, the length of resistance wire is such that the wire must follow along two rows, as shown in FIG. 2. Also, in order to have the ends 27 and 29 of the wire terminate at the same location, an even number of row with the same number of openings is required. In FIG. 2, this is shown by a pair of rows having four openings.

The heater design of FIG. 1 is not without its problems though. First, it requires that the ribbon be specially shaped with the portions 21 and 22 to maintain the spacing of the plates 3 and 5. Second, because of the need to match the rows in the plates so that the ends of the wire terminate on the same end, there is less flexibility in designing the heater with the necessary length of wire to meet the heating requirements. Third, manufacturing is complicated by having to thread the wires through two insulator plates and employ the portions 21 and 22 to maintain the spacing of the plates 3 and 5. Yet another problem is the length of the travel of the wire between the two plates. The longer the distance between the plates, the more opportunity for the wires to move and possibly contact each other and burn out the heater.

In light of the problems with the present day heaters, there is a need to provide improved heater designs, which simplify the manufacturing and offer more flexibility in meeting the heating load requirements via the configuration of the resistance wire with respect to the insulator plates.

In response to this need, the present invention provides an improved heater design, which eliminates many of the problems present in the prior art heaters.

SUMMARY OF THE INVENTION

It is a first object of the invention to provide an improved electrical resistance heater.

It is another object of the invention to provide an electrical heater that employs a resistance wire element and insulator plates that are folded together to create a more robust configuration than that found in prior art heaters employing similar kinds of insulator plates.

Other objects and advantages will become apparent as a description of the invention proceeds.

The invention is an improvement in electrical resistance heater that employs resistance wires, e.g., ribbons, which are woven through openings in an insulator plate such as mica board. In one embodiment, the invention comprises an electrical resistance wire heater that has at least first and second insulator plates, wherein each of the insulator plates have a plurality of openings therein to receive the resistance wire. The resistance wire passes through the plurality of openings in the first and second insulator plates in a looped configuration. At least one insulator is arranged adjacent to the looped resistance wire where the resistance wire contacts the openings for short circuit protection. The first and second insulator plates are folded with respect to each other in an angled configuration. The number of insulating plates and angles can vary depending on the heating requirements of the heater. Acute, right, or obtuse angles can be employed.

While the heater could employ just two insulator plates, a third insulator plate can be provided, which would be linked to the second insulator plate. The third insulator plate would also be folded with respect to the second insulator plate in an angled configuration.

The insulators can be made of any insulating material, with a preferred material being a mica material. The insulator adjacent to the resistance wire contacting the openings in the insulators plates can have any form; it can be a single component such as a plate or multiple components as so desired.

The resistance wire can have any configuration, e.g., circular, oval, or polygonal cross section, e.g., square or rectangular. A preferred configuration is a ribbon.

In another embodiment, the first and second insulator plates are folded over with respect to each other, with at least one insulator positioned between the folded over plates. One or more fasteners are employed to secure the three plates together, thus providing a more robust design of a heater.

The resistance wire and/or insulator plates can be configured so that ends of the resistance wire terminate on either the same side of the insulator plates or opposite sides of the insulator plates when the plates are in the folded over configuration or angled configuration.

In yet another embodiment, first and second insulator plates can be symmetrical in their opening configuration so that only one plate configuration is needed for manufacturing the heater.

Unlike prior art designs, angling the first and second insulator plates means that rows of openings in the insulator plates can be an odd number and still terminate on the same side of the heater.

Folding the insulator plates over each other allows for the manufacture of a heater wherein the looped configurations of the resistance wires can have different heights. The loops on one side of the heater can be shorter or longer than the other side to provide different heating if needed.

In the folded over heater configuration, the resistance wire will bend about 180 degrees when traveling from the first insulator plate to the second plate. To accommodate the fold or bend and when using an insulator shaped as a plate between the two plates securing the looped resistance wire, the insulator plate can include a notch to receive the resistance wire when bent.

The invention also includes a heater assembly that includes a heater and a heater frame. The inventive heater can be used in this heater assembly, with the inventive heater mounted to the heater frame in a fixed manner or a manner that permits the heater to move while mounted to the frame. For example, the heater could be configured so that one or more plate portions thereof engage a slot(s) in the heater, with the plate portion being able to move in the slot as a result of heater operation. Alternatively, the heater could be fixed at one portion and movably mounted at another portion to allow the heater to still move during operation. If desired, the heater could be rigidly secured to the frame as well.

The invention also is an improvement in the heating of a desired space or material using electrical resistance wires. The inventive heater can be used anywhere an electrical resistance wire heater would normally be used, e.g., clothes dryer, testing equipment, industrial applications of space heating, etc.

BRIEF DESCRIPTION OF THE DRAWINGS

Reference is now made to the drawings of the invention wherein.

DESCRIPTION OF THE PREFERRED EMBODIMENTS

Figure 4:
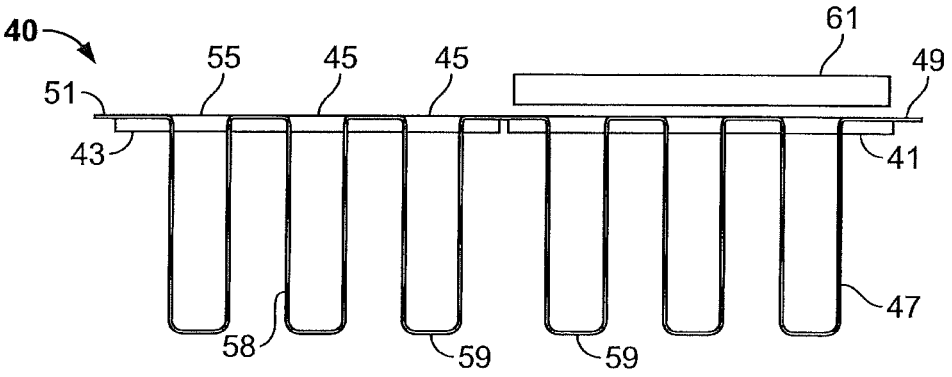
FIG. 4 shows a side view of a first embodiment of the inventive heater.
Figure 5:
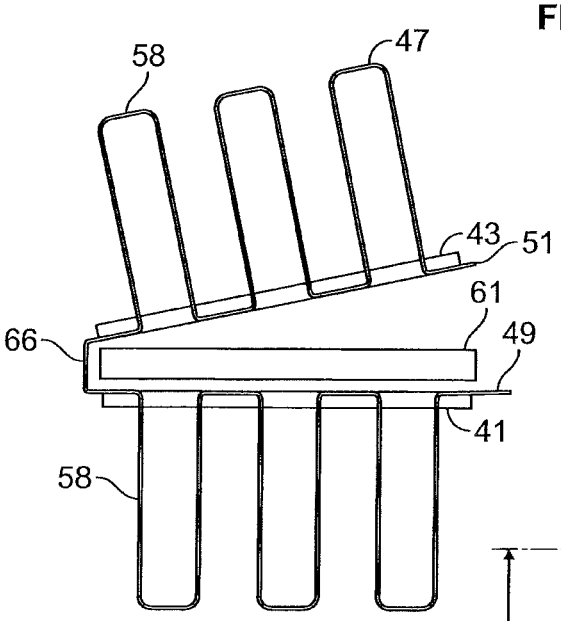
FIG. 5 shows the heater of FIG. 4 in a partially folded configuration.

One embodiment of the heater of the invention is shown in FIGS. 4-7. With reference to FIGS. 4 and 5, the inventive heater is designated by the reference numeral 40 and includes a pair of insulator plates 41 and 43.

Each of the plates 41 and 43 has a number of openings 45, which are sized to receive a resistance wire 47. The resistance wire passes through the openings 45, starting at a first end 49 and terminating at a second end 51.

Figure 1:
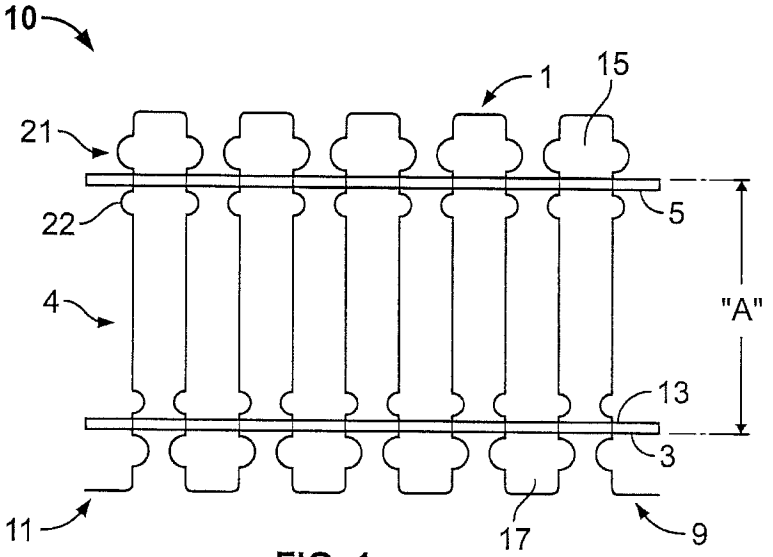
FIG. 1 (Prior Art)
FIG. 1 is a side view of a prior art heater configuration.
Figure 7:
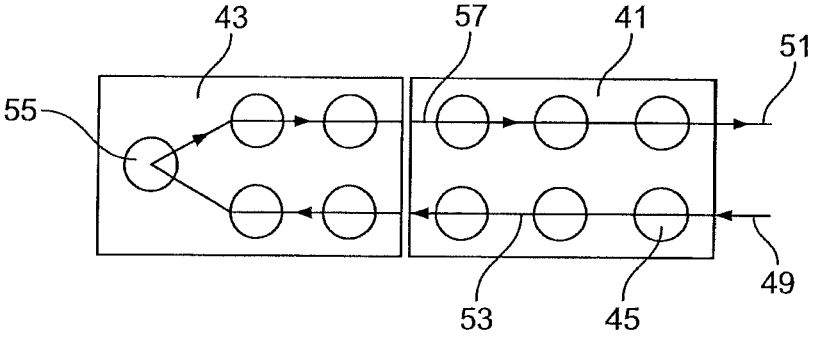
FIG. 7 shows a top view of the insulator plates of the heater of FIG. 4.

As seen in FIGS. 4 and 7, the wire 47, starting at end 49 loops between adjacent openings 45 along row 53, crosses over via opening 55 to a second row 57, and then travels along second row 57, terminating at end 51 the wire 47 extending across a gap between the adjacent plates 41 and 43 as it travels between the ends 49 and 51. Comparing the prior art design of FIG. 1 with the embodiment of FIG. 4, it is apparent that it is much easier to loop the wire 47 through the side-by-side plates 41 and 43, since loop 58 can have a free end 59 as opposed to the requirement that the loops extend through each plate of the prior art design. In FIG. 1, the loop requires an additional step of threading of the wire through the openings in the second plate 5, which is not required when making the inventive heater. While one resistance wire is illustrated for the inventive heater, it should be understood that the heater could have the required number of openings and row to accommodate more than one resistance wire, if needed.

FIG. 4 also shows an additional insulator in the form of a plate 61, which is designed to provide additional insulating protection against wire-to-wire contact when the plates 41 and 43 are folded together. While a plate is shown, other shapes or configurations could be employed to maintain spacing between the plates 41 and 43. For example, a number of discrete insulators could be positioned in spaced-apart locations between the plates 41 and 43 to maintain a spacing between the wires when looped through the plates 41 and 43.

The insulator plates and insulator can be made of any insulating material, with a preferred material being mica. The resistance wire is preferably a ribbon, but virtually any configuration wire can be used that would be able to be looped through the openings in the plates 41 and 43 as shown.

Figure 6B:
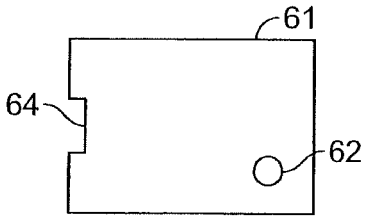
FIG. 6B shows an exemplary insulator for the heater of FIG. 4.
Figure 6A:
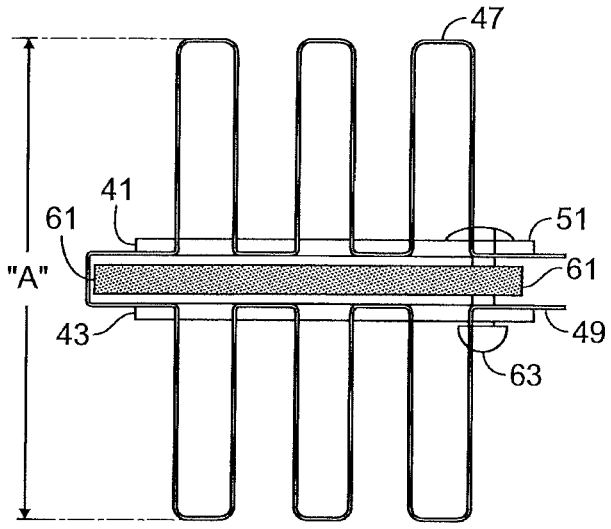
FIG. 6A shows the heater of FIG. 4 in a fully folded configuration.

FIGS. 5-6B show the heater 40 in the partially folded and folded positions, with the additional insulator plate 61 in position. FIG. 6A also illustrates a fastener 63, which extends through an opening (not shown) in each of the plates 41, 43, and 61. The fastener can be any type that would hold the three plates together, thereby providing a more robust connection between the plates as compared to the embodiment of FIG. 1, which must rely on the ribbon 1 to connect the plates together and maintain spacing. FIG. 6B shows just the plate 61 and its opening 62 to receive the fastener 63. A corresponding opening is located in each of the plates 41 and 43 to permit fastening. While one opening 62 is shown, more than one opening could be employed to better secure the plates 41 and 43 together. The plate 61 also includes a notch 64. The notch is designed to provide a space for the portion 66 of the wire extending between the two plates 41 and 43, see FIG. 5. The notch facilitates the travel of the wire from one loop 58 on plate 41 to the beginning of a second loop 58 on plate 43.

Referring again to FIG. 7, it can be seen that the number of openings between the plates 41 and 43 do not have to match to have the wire 47 terminate on the same end of the plates. Plate 41 has two rows of three openings, with plate 43 having two rows of only two openings.

Figure 2:
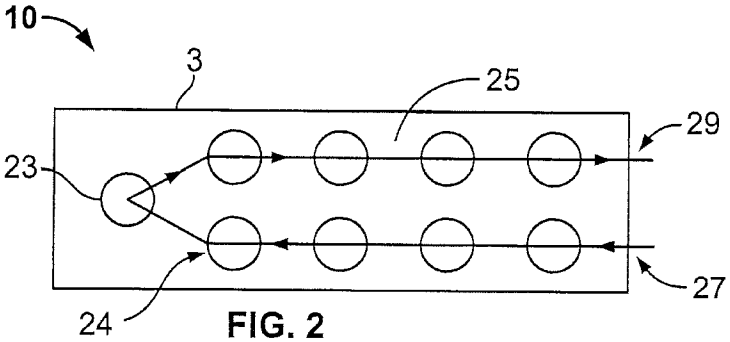
FIG. 2 (Prior Art)
FIG. 2 shows a top view of a prior art insulator plate for use in the heater of FIG. 1.
Figure 8:
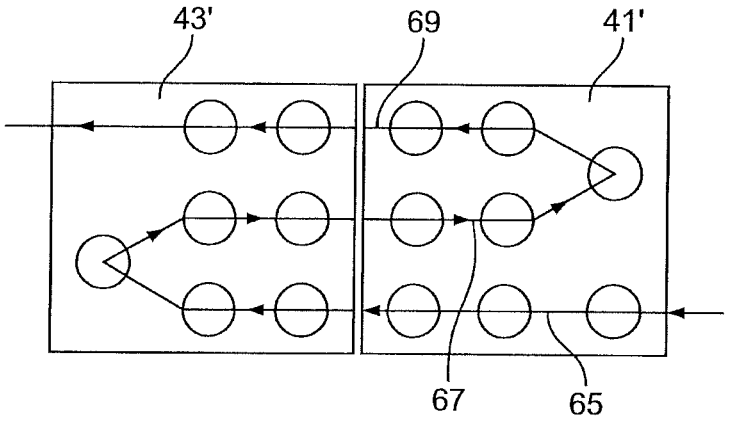
FIG. 8 shows another embodiment of the heater of FIG. 4 with a different plate configuration.

FIG. 8 shows another embodiment of the invention. In the embodiment of FIGS. 1 and 2, and even number of rows is required to ensure that the terminal ends of the resistance wire end up on the same side of the plate. The inventive heater has the ability to employ odd numbers of rows, which provide more flexibility in defining the length of the wire for the heater and the heating load. That is, FIG. 8 shows that the plates 41' and 43' can have three rows 65, 67, and 69 for the wire to travel and still have termination of the wire on the same side of the heater.

One significant advantage of the invention is that the heater 40 can match the height "A" used in the prior art heaters, but with loops of wire that are only roughly half the length, see FIG. 6A. This eliminates or reduces the problems noted above when the wire between the plates of the prior art heater is of a certain length. With the inventive heater, the wire length for a loop is significantly decreased. As seen in FIG. 6A, the heater 40 can still match dimension "A" of the prior art heater, but without the complicated looping and wire configuration. Since the dimension "A" of the prior art heater is one that is dictated by, at least, the particular heater application and installation, it is a significant advantage of the invention to be able to make a heater with such a dimension but in a significantly simpler and more cost effective way.

Figure 9:
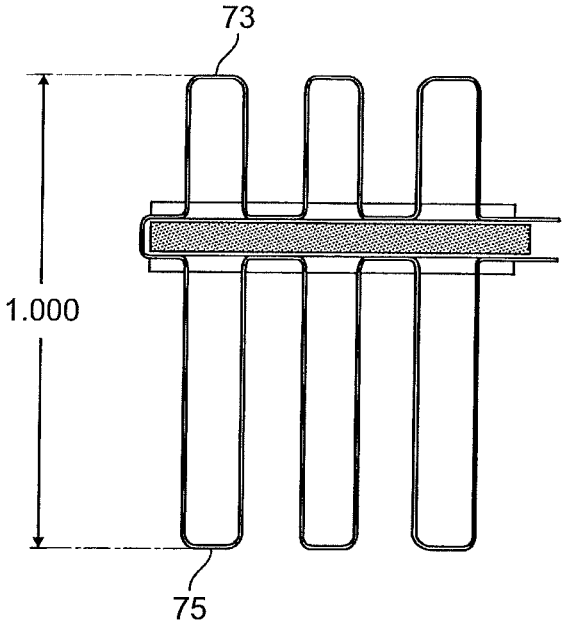
FIG. 9 shows another embodiment of the heater of FIG. 4 with an alternative resistance wire configuration.

FIG. 9 illustrates the aspect of the invention, wherein the loop length of the wire can vary for each side of the heater. Whereas the prior art design is limited to a set distance between the insulator plates, the inventive heater can provide one set of loops that are a different height than the other set of loops. Thus, for a heater design of 1 inch in width, the heater of FIG. 9 can have loops 73 that are shorter in height than loops 75. In this embodiment, the loops 75 are approximately twice as larger, 0.67 inches versus 0.33 inches. This provides more flexibility in heater design since a zone may need more heat than another zone and loops 75 would be used to heat the zone requiring more heat.

Figure 11:
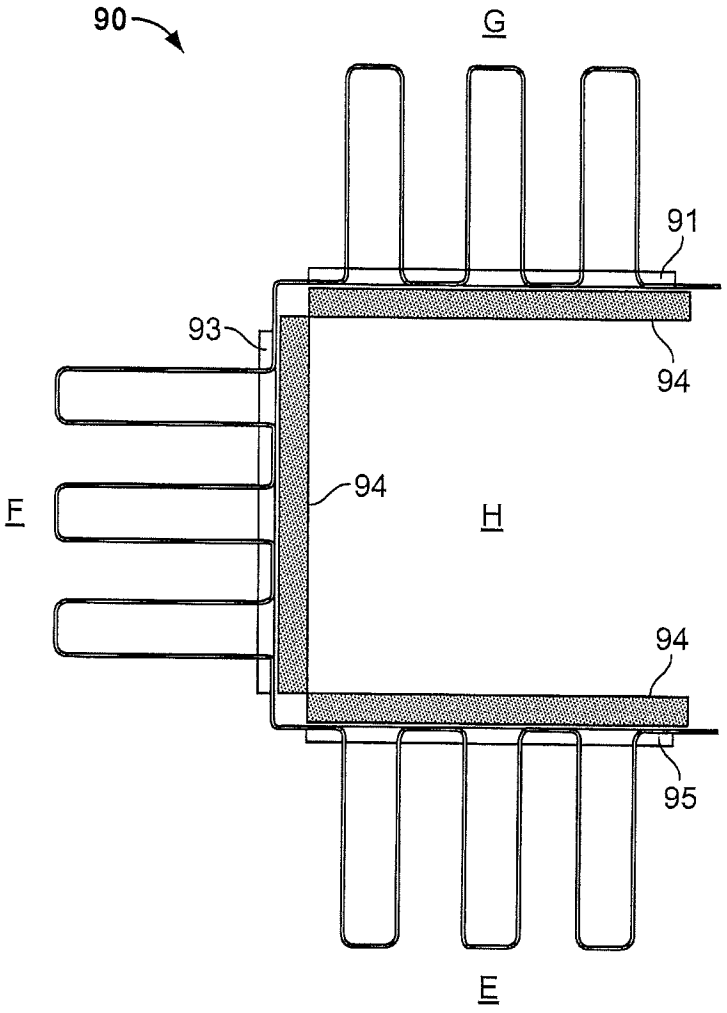
FIG. 11 shows yet another embodiment of the heater of FIG. 4 with a still different folded configuration.
Figure 10:
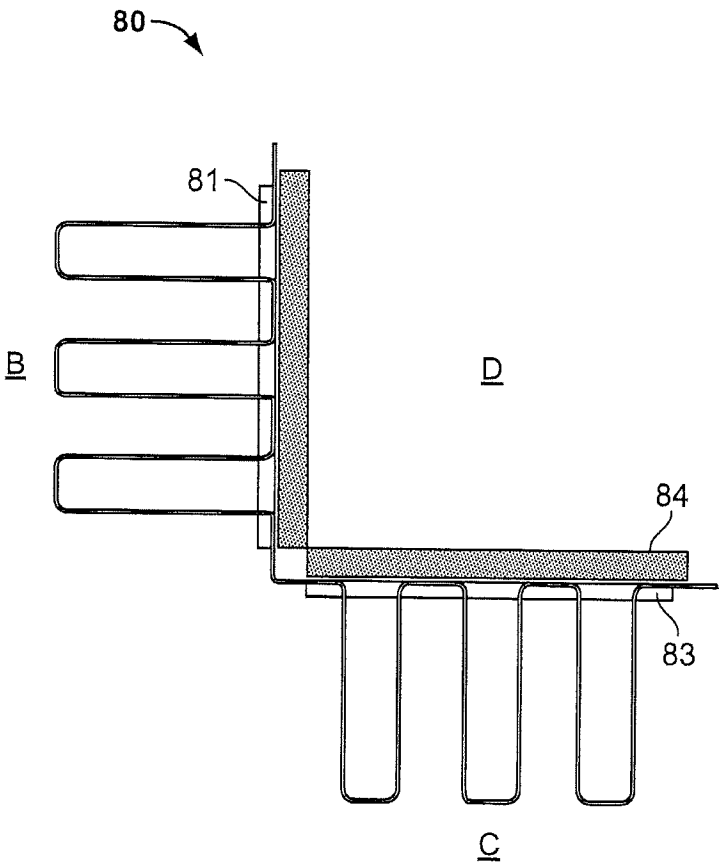
FIG. 10 shows an alternative embodiment to the heater of FIG. 4, showing a different folded configuration.

FIGS. 10 and 11 show other embodiments of the invention. FIG. 10 shows a heater 80 having an L-shaped configuration. In this configuration, the heater has plates 81 and 83 that can be positioned so that they form a right angle so that heat is supplied to zones B and C. Little or no heat is applied to zone D as a result of the placement of the insulator plate 84. Unlike the embodiment of FIGS. 4-7, the insulator plates are not fastened together. Instead, the plates would be attached to a frame or other structure of the heater for support as detailed below.

FIG. 11 shows a heater 90 with a u-shaped configuration. This heater employs three plates 91, 93, and 95 so that heat is supplied to three zones E, F, and G. Little or no heat is applied in zone H as a result of insulator plate 94.

The embodiments depicted in FIGS. 10 and 11 are only exemplary and other configurations could be employed to provide heat in certain zones only. For example, five plates could be used to form an S-like configuration. More, the angle between two plates could be more or less than the 90 degrees shown in FIG. 10 as the configuration would dictate, e.g., acute or obtuse.

In each of the embodiments of FIGS. 10 and 11, insulator plates 84 and 94, respectively are arranged with each insulator plate receiving the resistance wire. The plates 84 and 94 provide further protection against shorting of the wire threaded in openings in the insulator plates 81 and 83 and insulator plates 91, 93, and 95 as well as isolating zones where heat is not needed. Although not shown, the insulator plate 84 and 94 can be attached to the plates holding the resistance wire in any known fashion, e.g., fasteners or the like. The arrangements can be mounted in a similar fashion as described below for the other embodiments of the invention so that specific illustrations of the plate mounting are not necessary for understanding of these embodiments.

The invention provides significant advantages over the prior art designs. One improvement relates to the ease of manufacture of the heater. In the prior art design of FIGS. 1 and 2, the expansion or forming of the protruded portions 21 and 22 of the wire needed to maintain the separation of the plates must be done as the wire is threaded through the openings or after the heater is assembled. In contrast, in the invention, the two plates of the embodiment of FIGS. 4-8 are connected using a fastener or the like and this rigid connection eliminates the requirement for expanding the resistance wire to maintain the spacing between the plates. In addition, the heater, when using the fastened-together three plate design of FIGS. 4-8, is much more robust since the three plates being held together impart an improved rigidity to the heater. In the prior art, the resistance wire itself provides a rigidity to the heater for a substantial part of it, but this is far less than what is provided by the inventive heater.

Figure 3:
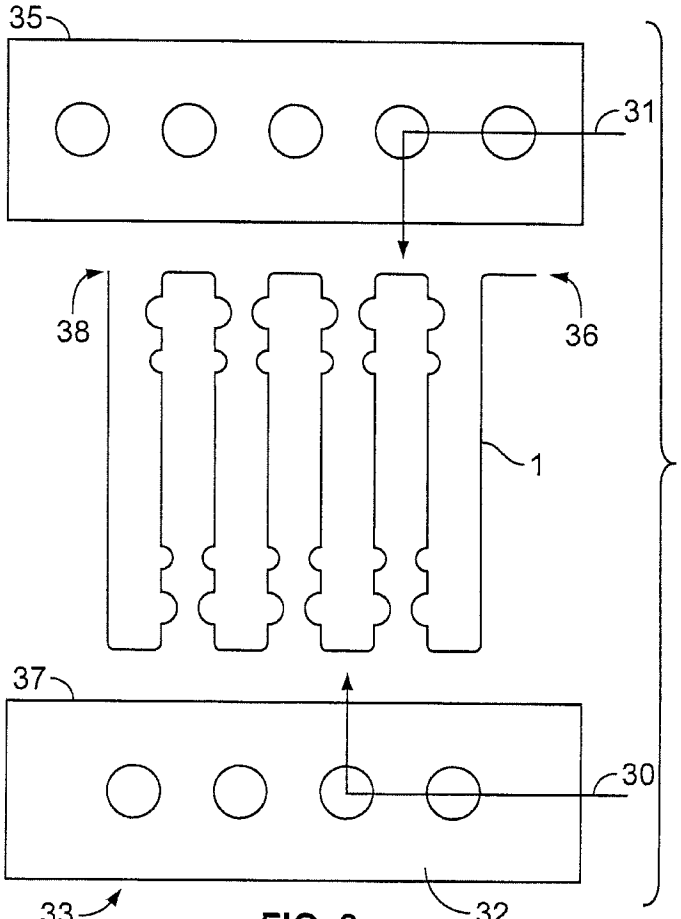
FIG. 3 (Prior Art)
FIG. 3 shows an exploded view of a prior art heater, showing the resistance wire and opposing insulator plates.
Figure 12:
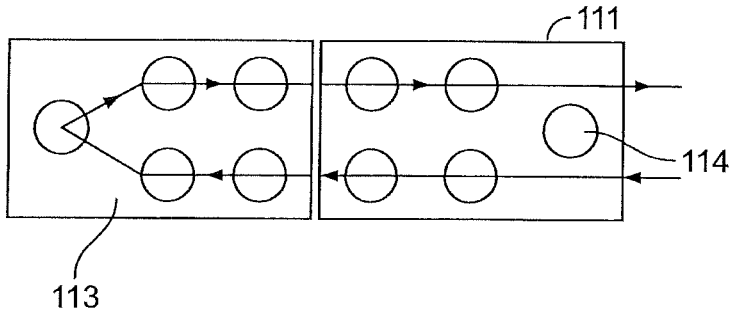
FIG. 12 shows a pair of symmetric insulator plates for use as part of the inventive heater.

Because of the use of two opposing plates in the prior art design of FIGS. 1-3 and the requirement that the resistance wire being threaded through the openings in the plates, the plates of the prior art design are not symmetrical. This is because the location of the openings in the top plate does not align with the location of the openings in the bottom plate and two plates of different opening configuration must be used for the heater, see FIG. 3. Because the inventive heater only threads the resistance wire through the openings in one plate at a time, the plates making up the heater can be symmetric, thus reducing manufacturing costs. This is shown in FIG. 12, wherein each of plates 111 and 113 has the same opening pattern. While one opening 114 does not receive the resistance wire, the cost of making this additional opening is inconsequential when considering that two different plates do not have, to be made to form the heater.

Figure 13:
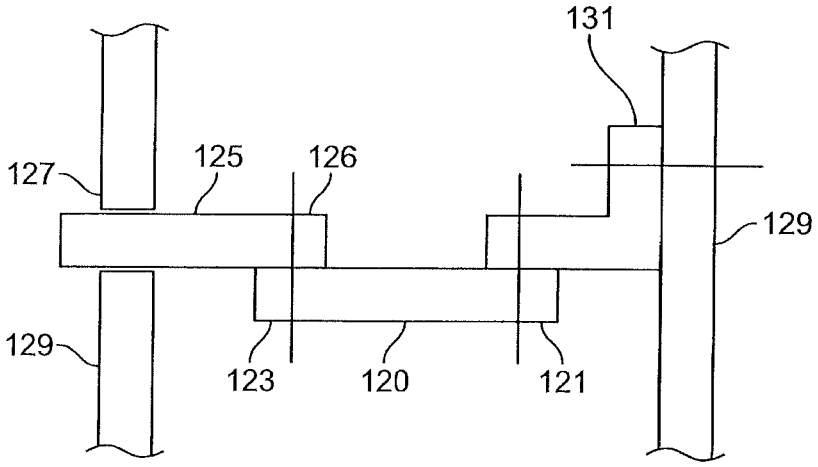
FIG. 13 is a schematic representation of a mounting of the inventive heater to a heater frame.

The heater of the invention can be mounted in the same manner as the prior art heater, i.e., ends of the insulator plates could engage slots in a heater frame without a fixed attachment. Alternatively, one or both ends of the folded over plates could be rigidly attached to a heater support structure. For the embodiments of FIGS. 11 and 12, the plates could also have a loose engagement with a heater structure, wherein the plates merely engage slots or have rigid attachments for the plates or a combination thereof. FIG. 13 shows a schematic of an exemplary mounting of the heater to a heater frame. The folded over heater is schematically identified by reference numeral 120, but without showing the looped resistance wire, which would run across the page when viewing the drawing, wire ends, one or more fasteners holding the plates together, etc. One end 121 of the heater 120 has the terminations of the resistance wire with the other end 123 having the fold of the resistance wire. The end 123 has a plate 125, with one end of the plate 125 attached to the heater 120 at 126. The other end of the plate 125 engages a slot 127 in a heater frame 129. The attachment can be any type, a fastener or the like. The other end of the heater 121 can be rigidly attached to the frame 129 using a bracket 131. It should be understood that the manner in which the heater 120 would be supported by a heater frame is exemplary in FIG. 13 and other configurations can be used that would encompass loose or sliding attachment for both ends of the heater or fixed attachment at one end. While not often employed, certain heater applications could even permit a fixed attachment at both ends of the heater. While the short ends of the heater are shown as connecting to a heater frame, the long ends of the heater could also be supported, either alone or in combination with the short ends. Additional supports along the length of the heater could also be employed if necessary.

The heater can be used in virtually any application that requires heating of a space or a material. These applications include heating equipment for testing or analyzing, clothes dryers, wherein a moving stream of air is heated, industrial heating of air or other gases, and the like. The heater can be used in virtually any mounted arrangement that would permit the desired heating to take place.

As such, an invention has been disclosed in terms of preferred embodiments thereof which fulfills each and every one of the objects of the present invention as set forth above and provides a new and improved electric resistance heater and its method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A foldable electrical resistance wire heater comprising:

at least first and second rigid, separated insulator plates, each plate having a longitudinal length, wherein each of the insulator plates has a plurality of openings therethrough to receive resistance wire;

at least one resistance wire passing through the plurality of openings in the first and second rigid separated insulator plates, wherein the plurality of openings in the first and second rigid, separated insulator plates comprise at least two rows of openings running along the longitudinal length and at least one single opening in at least one of the first and second rigid, separated insulator plates other than the at least two rows of openings;

wherein said resistance wire forms a plurality of loops, each loop comprising a loop bend joined by adjacent loop segments, the first rigid separated insulator plate having a first set of loops and the second rigid separated insulator plate having a second set of loops different from the first set of loops;

wherein loop bends of a plurality of said loops pass through a plurality of openings in said first or second rigid separated insulator plates, in the longitudinal direction, the plurality of the loops passing through the plurality of openings in the longitudinal direction reverse in the longitudinal direction via the at least one single opening in the at least one of the first or second rigid, separated insulator plates;

the plurality of loops passing through the plurality of adjacent openings in the first or second rigid insulator plates extending beyond a first surface of each of said first and said second rigid separated insulator plates; and a plurality of insulators, each insulator having opposing first and second surfaces, the first surface of an insulator of the plurality of insulators arranged adjacent to a second surface of each of the at least first and second rigid separated insulator plates, the second surface of each of the at least first and second rigid separated insulator plates opposing the first surface of each of said at least first or said second rigid separated insulator plates, the plurality of insulators providing for short circuit protection, wherein the at least first and second rigid separated insulator plates are linked by a portion of said resistance wire spanning a gap created by the first and second rigid separated insulator plates, the at least first and second rigid separated insulator plates defining a fold angle with respect to said surfaces of said first and second rigid separated insulator plates, wherein the at least first and second separated insulator plates, the gap, an absence of heater structure extending from another side of the at least one insulator create the foldable electric resistance wire heater so that the plurality of loops of resistance wire for each first and second rigid separated insulator plates can have different planar orientations and the at least first and second rigid separated insulator plates being folded such that the at least first and second rigid separated insulator plates are in different planes and each of the at least first and second rigid separated insulator plates have a terminating face that does not form a gap with an adjacent rigid separated insulator plate nor define at least one end of the resistance wire extending to a set of loops of the adjacent rigid separated insulator plate, and further wherein each of the at least first and second rigid separated insulator plates are initially coplanar, and, by being foldable, the first and second rigid separated insulator plates can have a range of motion such that a first plane corresponding to the first rigid separated insulator plate can intersect a second plane corresponding to the second rigid separated insulator plates, and be able to form different angles of inclination between the first and second rigid separated insulator plates, wherein the angle of inclination between the at least first and second rigid separated insulator plates ranges between an acute angle and an obtuse angle.

2. A foldable electrical resistance wire heater comprising:

first, second, and third rigid, separated insulator plates, each plate having a longitudinal length, wherein each of the first, second, and third rigid, separated insulator plates has a plurality of openings therethrough to receive resistance wire and first and second opposing surfaces;

at least one resistance wire passing through the plurality of openings in the first, second, and third rigid separated insulator plates, wherein the plurality of openings in the first, second and third rigid, separated insulator plates comprise at least two rows of openings running along the longitudinal length and at least one single opening in at least one of the first, second and third rigid, separated insulator plates other than the at least two rows of openings;

wherein said resistance wire forms a plurality of loops, each loop comprising a loop bend joined by adjacent loop segments, the first rigid separated insulator plate having a first set of loops and the second rigid separated insulator plate having a second set of loops different from the first set of loops and the third rigid separated insulator plate having a third set of loops different from the first and second set of loops;

wherein loop bends of a plurality of said loops pass through a plurality of openings in said first, second, or third rigid separated insulator plates, in the longitudinal direction, the plurality of the loops passing through the plurality of openings in the longitudinal direction reverse in the longitudinal direction via the at least one single opening in the at least one of the first, second, or third rigid, separated insulator plates;

the plurality of loops passing through the plurality of adjacent openings in the first, second, or third rigid separated insulator plates extending beyond the first opposing surface of each of said first, said second, and said third rigid separated insulator plates; and wherein the at least first and second rigid separated insulator plates are linked by a portion of said resistance wire spanning a first gap created by the first and second rigid separated insulator plates, the first and second rigid separated insulator plates defining a first fold angle with respect to said surfaces of said first and second rigid separated insulator plates, and the second and third rigid separated insulator plates are linked by another portion of said resistance wire spanning a second gap created by the second and third separated insulator plates, the second and third rigid separated insulator plates defining a second fold angle with respect to said surfaces of said second and third rigid separated insulator plates, the first and second rigid separated insulator plates are folded with respect to each other such that the first and second rigid separated insulator plates are in different planes and the second and third rigid separated insulator plates are folded with respect to each other such that the second and third rigid separated insulator plates are in different planes, each of the first and third rigid separated insulator plates have a terminating face that does not form a gap with an adjacent rigid separated insulator plate nor define at least one end of the resistance wire extending to a set of loops of the adjacent rigid separated insulator plate, and further wherein each of the at least first, second, and third rigid separated insulator plates are initially coplanar, and, by being foldable, the first, second, and third rigid separated insulator plates can have a range of motion such that a first plane corresponding to the first rigid separated insulator plate can intersect a second plane corresponding to the second rigid separated insulator plates so as to be able to form different angles of inclination between the first and second rigid insulator separated plates, and a third plane corresponding to the third rigid separated insulator plate can intersect the second plane of the second rigid separated insulator plate so as to be able to form different angles of inclination between the second and third rigid separated insulator plates, wherein the at least first, second, and third rigid, separated insulator plates are arranged in a u-shape, and further wherein the plurality of loops passing through the plurality of adjacent openings in the first, second, and third rigid separated insulator plates extend only from the first opposing surface of each of said first, second, and third rigid separated insulator plates; and wherein first, second, and third insulators are provided, each of the first, second, and third insulators having opposing first and second surfaces, the opposing first surface of the first insulator arranged adjacent to the second opposing surface of the first rigid separated insulator plate, the opposing first surface of the second insulator arranged adjacent to the second opposing surface of the second rigid separated insulator plate, and the opposing first surface of the third insulator arranged adjacent to the second opposing surface of the third rigid separated insulator plate, the plurality of insulators providing for short circuit protection.

3. The heater of claim 1, wherein the at least first and second separated rigid insulator plates and insulator are made from mica.

4. The heater of claim 1, wherein the at least one insulator is a plate.

5. The heater of claim 1, wherein the resistance wire is a ribbon.

6. A folded electrical resistance wire heater comprising:

first and second rigid, separated insulator plates, each plate having a longitudinal length, wherein each of the first and second rigid, separated insulator plates has a plurality of openings therethrough to receive resistance wire;

at least one resistance wire passing through the plurality of openings in the first and second rigid separated insulator plates, wherein the plurality of openings in the first and second rigid, separated insulator plates comprise at least two rows of openings running along the longitudinal length and at least one single opening in at least one of the first and second rigid, separated insulator plates other than the at least two rows of openings;

wherein said resistance wire forms a plurality of loops, each loop comprising a loop bend joined by adjacent loop segments, the first rigid separated insulator plate having a first set of loops and the second rigid separated insulator plate having a second set of loops different from the first set of loops;

wherein loop bends of a plurality of said loops pass through a plurality of openings in said first or second rigid separated insulator plates, in the longitudinal direction, the plurality of the loops passing through the plurality of openings in the longitudinal direction reverse in the longitudinal direction via the at least one single opening in the at least one of the first or second rigid, separated insulator plates;

the plurality of loops passing through the plurality of adjacent openings in the first or second rigid insulator plates extending beyond a surface of each of said first or said second rigid separated insulator plates; and one insulator arranged adjacent to an opposing surface of each of said first and said second rigid separated insulator plates for short circuit protection, wherein the first and second rigid separated insulator plates each have first ends that are linked by a portion of said resistance wire spanning a gap created by the first and second rigid separated insulator plates, the resistance wire extending through both the openings in the first rigid separated insulator plate and the openings in the second rigid separated insulator plate, the first and second rigid separated insulator plates defining a fold angle with respect to said surfaces of said first and second rigid separated insulator plates, wherein each of the first and second rigid separated insulator plates have a second end with a terminating end face, each terminating end face does not form a gap with an adjacent rigid separated insulator plate nor define at least one end of the resistance wire extending to a set of loops of the adjacent rigid separated insulator plate, wherein said one insulator is sandwiched between said opposing surfaces of said first and second rigid separated insulator plates and at least one fastener holds the first and second rigid separated insulator plates together at the second ends of the first and second rigid separated insulator plates, and further wherein each of the at least first and second rigid separated insulator plates are initially coplanar, and, upon being folded, a first plane corresponding to the first rigid separated insulator plate is parallel to a second plane corresponding to the second rigid separated insulator plates.

7. The heater of claim 6, wherein first and second ends of the resistance wire terminate on a same side of either of the at least first or second rigid separated insulator plates.

8. The heater of claim 6, wherein the first and second separated rigid insulator plates are symmetrical in terms of locations of the plurality of openings in each of the first and second separated rigid insulator plates.

9. The heater of claim 6, wherein the plurality of openings in each of the first and second separated rigid insulator plates further comprises an odd number of rows of openings.

10. The heater of claim 6, wherein a first set of loops extends from the first rigid separated insulator plate and a second set of loops extends from the second separated rigid insulator plate, wherein a height of the first set of loops is different from a height of the second set of loops.

11. The heater of claim 6, wherein the resistance wire is bent in about a 180 degree angle when traveling from the first separated rigid insulator plate to the second separated rigid insulator plate.

12. The heater of claim 11, wherein the insulator is a plate and the plate has a notch to accommodate the bend of the resistance wire.

13. A heater assembly comprising a heater frame and the heater of claim 1.

14. The heater assembly of claim 13, wherein the heater is supported by the heater frame so that it can move with respect to the heater frame.

15. A heater assembly comprising a heater frame and the heater of claim 2.

16. The heater assembly of claim 15, wherein the heater is supported by the heater frame so that it can move with respect to the heater frame.

17. A method of heating a space or material comprising:

providing a foldable electric resistance wire heater comprising:

at least first and second rigid, separated insulator plates, each plate having a longitudinal length, wherein each of the insulator plates has a plurality of openings therethrough to receive resistance wire;

at least one resistance wire passing through the plurality of openings in the first and second rigid separated insulator plates, wherein the plurality of openings in the first and second rigid, separated insulator plates comprise at least two rows of openings running along the longitudinal length and at least one single opening in at least one of the first and second rigid, separated insulator plates other than the at least two rows of openings;

wherein said resistance wire forms a plurality of loops, each loop comprising a loop bend joined by adjacent loop segments, the first rigid separated insulator plate having a first set of loops and the second rigid separated insulator plate having a second set of loops different from the first set of loops;

wherein loop bends of a plurality of said loops pass through a plurality of openings in said first or second rigid separated insulator plates, in the longitudinal direction, the plurality of the loops passing through the plurality of openings in the longitudinal direction reverse in the longitudinal direction via the at least one single opening in the at least one of the first or second rigid, separated insulator plates;

the plurality of loops passing through the plurality of adjacent openings in the first or second rigid insulator plates extending beyond a surface of each of said first and said second rigid separated insulator plates; and a plurality of insulators, each insulator having opposing first and second surfaces, the first surface of an insulator of the plurality of insulators arranged adjacent to a second surface of each of the at least first and second rigid separated insulator plates, the second surface of each of the at least first and second rigid separated insulator plates opposing the first surface of each of said at least first or said second rigid separated insulator plates, the plurality of insulators providing for short circuit protection, wherein the at least first and second rigid separated insulator plates are linked by a portion of said resistance wire spanning a gap created by the first and second rigid separated insulator plate, the at least first and second rigid separated insulator plates defining a fold angle with respect to said surfaces of said first and second rigid separated insulator plates, wherein the at least first and second separated insulator plates, the gap, an absence of heater structure extending from the first and second surfaces of the at least one insulator create the foldable electric resistance wire heater so that the plurality of loops of resistance wire for each first and second rigid separated insulator plates can have different planar orientations and the at least first and second rigid separated plates are folded such that the at least first and second rigid separated plates are in different planes and each of the at least first and second rigid separated plates have a terminating face that does not form a gap with an adjacent rigid separated plate nor define at least one end of the resistance wire extending to a set of loops of the adjacent rigid separated insulator plate; and further wherein each of the at least first and second rigid separated insulator plates are initially coplanar, and, by being foldable, the first and second rigid separated insulator plates can have a range of motion such that a first plane corresponding to the first rigid separated insulator plate can intersect a second plane corresponding to the second rigid separated insulator plates, and be able to form different angles of inclination between the first and second rigid separated insulator plates;

wherein the angle of inclination between the at least first and second rigid separated insulator plates ranges between an acute angle and an obtuse angle; and heating said space or material with the folded electrical resistance wire heater.

18. A method of heating a space or material comprising:

providing a folded electrical resistance wire heater comprising:

first and second rigid, separated insulator plates, each plate having a longitudinal length, wherein each of the first and second rigid, separated insulator plates has a plurality of openings therethrough to receive resistance wire;

at least one resistance wire passing through the plurality of openings in the first and second rigid separated insulator plates, wherein the plurality of openings in the first and second rigid, separated insulator plates comprise at least two rows of openings running along the longitudinal length and at least one single opening in at least one of the first and second rigid separated insulator plates other than the at least two rows of openings;

wherein said resistance wire forms a plurality of loops, each loop comprising a loop bend joined by adjacent loop segments, the first rigid separated insulator plate having a first set of loops and the second rigid separated insulator plate having a second set of loops different from the first set of loops;

wherein loop bends of a plurality of said loops pass through a plurality of openings in said first or second rigid separated insulator plates, in the longitudinal direction, the plurality of the loops passing through the plurality of openings in the longitudinal direction reverse in the longitudinal direction via the at least one single opening in the at least one of the first or second rigid, separated insulator plates;

the plurality of loops passing through the plurality of adjacent openings in the first or second rigid insulator plates extending beyond a surface of each of said first or said second rigid separated insulator plates; and one insulator arranged adjacent to an opposing surface of each of said first and said second rigid separated insulator plates for short circuit protection, wherein the first and second rigid separated insulator plates each have first ends that are linked by a portion of said resistance wire spanning a gap created by the first and second rigid separated insulator plates, the resistance wire extending through both the openings in the first rigid separated insulator plate and the openings in the second rigid separated insulator plate, the first and second rigid separated insulator plates defining a fold angle with respect to said surfaces of said first and second rigid separated insulator plates, wherein each of the first and second rigid separated insulator plates have a second end with a terminating end face, each terminating end face does not form a gap with an adjacent rigid separated insulator plate nor define at least one end of the resistance wire extending to a set of loops of the adjacent rigid separated insulator plate, wherein said one insulator is sandwiched between said opposing surfaces of said first and second rigid separated insulator plates and at least one fastener holds the first and second rigid separated insulator plates together at the second ends of the first and second rigid separated insulator plates, and further wherein each of the at least first and second rigid separated insulator plates are initially coplanar, and, upon being folded, a first plane corresponding to the first rigid separated insulator plate is parallel to a second plane corresponding to the second rigid separated insulator plates, and heating said space or material with the folded electrical resistance wire heater.

19. The heater of claim 1 wherein a plurality of loops consecutively pass through a plurality of openings in either the first or second plates.

20. The heater of claim 1, wherein a single resistance wire passes through the plurality of openings in the first and second rigid separated plates, the plurality of openings in each of the first and second rigid separated plate comprising at least two rows of openings running along the longitudinal length of the each of the first and second rigid separated plates.

21. The heater of claim 2, wherein a single resistance wire passes through the plurality of openings in the first, second, and third rigid separated plates, the plurality of openings in each of the first, second, and third rigid separated plate comprising at least two rows of openings running along the longitudinal length of the each of the first, second, and third rigid separated plates.

22. The heater of claim 6, wherein a single resistance wire passes through the plurality of openings in the first and second rigid separated plates, the plurality of openings in each of the first and second rigid separated plate comprising at least two rows of openings running along the longitudinal length of the each of the first and second rigid separated plates.

23. The heater of claim 1, wherein first and second ends of the at least one resistance wire terminate on a same side of the at least first or second rigid separated insulator plates.

24. The heater of claim 2, wherein first and second ends of the at least one resistance wire terminate on a same side of the at least first and third rigid separated insulator plates.

25. The heater of claim 7, wherein first and second ends of the resistance wire terminate on a same side of the at least first or second rigid separated insulator plates.

26. The heater of claim 23, wherein a single resistance wire passes through the plurality of openings in the first and second rigid separated plates, the plurality of openings in each of the first and second rigid separated plate comprising at least two rows of openings running along the longitudinal length of the each of the first and second rigid separated plates.

27. The heater of claim 24, wherein a single resistance wire passes through the plurality of openings in the first, second, and third rigid separated plates, the plurality of openings in each of the first, second, and third rigid separated plate comprising at least two rows of openings running along the longitudinal length of the each of the first, second, and third rigid separated plates.

28. The heater of claim 25, wherein a single resistance wire passes through the plurality of openings in the first and second rigid separated plates, the plurality of openings in each of the first and second rigid separated plate comprising at least two rows of openings running along the longitudinal length of the each of the first and second rigid separated plates.

* * * * *